US009982941B2

(12) United States Patent
Fujita et al.

(10) Patent No.: US 9,982,941 B2
(45) Date of Patent: May 29, 2018

(54) DRYING APPARATUS

(71) Applicant: NGK Insulators, Ltd., Nagoya (JP)

(72) Inventors: Shuhei Fujita, Nagoya (JP); Shinya Yoshida, Nagoya (JP); Hiroyuki Tsuji, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 350 days.

(21) Appl. No.: 14/832,196

(22) Filed: Aug. 21, 2015

(65) Prior Publication Data

US 2015/0354892 A1 Dec. 10, 2015

Related U.S. Application Data

(63) Continuation of application No. PCT/JP2014/054467, filed on Feb. 25, 2014.

(30) Foreign Application Priority Data

Feb. 26, 2013 (JP) ..... 2013-035924
Oct. 21, 2013 (JP) ..... 2013-218253

(51) Int. Cl.
*F26B 3/28* (2006.01)
*F26B 3/30* (2006.01)
(Continued)

(52) U.S. Cl.
CPC ..... *F26B 3/283* (2013.01); *F26B 3/30* (2013.01); *F26B 13/10* (2013.01); *B05D 3/0263* (2013.01)

(58) Field of Classification Search
CPC . F26B 3/283; F26B 3/30; F26B 13/10; B05D 3/0263
See application file for complete search history.

(56) References Cited

U.S. PATENT DOCUMENTS 6,537,600 B1 * 3/2003 Meldrum ..... A23B 7/005 426/102
6,858,261 B1 2/2005 Bär et al.
(Continued)

FOREIGN PATENT DOCUMENTS

CN 202547304 U 11/2012
DE 198 57 045 A1 6/2000
(Continued)

OTHER PUBLICATIONS

International Search Report and Written Opinion (Application No. PCT/JP2014/054467) dated May 13, 2014.
(Continued)

*Primary Examiner* — Jessica Yuen
(74) *Attorney, Agent, or Firm* — Burr & Brown, PLLC

(57) ABSTRACT

A drying apparatus includes a furnace body; a conveyor belt configured to move in an interior space of the furnace body, with an object to be dried loaded thereon; and a plurality of infrared heaters arranged above the conveyor belt in the interior space of the furnace body. A division wall is provided, which divides the interior space of the furnace body into a space S1 including the conveyor belt and a space S2 including the infrared heaters. In the division wall, first portions located at positions corresponding to the respective infrared heaters in the longitudinal direction are made of a material that transmits infrared radiation, whereas second portions located at positions corresponding to respective spaces between adjacent infrared heaters in the longitudinal direction are made of a material that does not transmit infrared radiation.

4 Claims, 4 Drawing Sheets

(51) Int. Cl.
*F26B 13/10* (2006.01)
*B05D 3/02* (2006.01)

(56) References Cited

U.S. PATENT DOCUMENTS

| | | | |
|---|---|---|---|
| 2002/0027628 | A1 | 3/2002 | Ishizuka et al. |
| 2005/0018116 | A1 | 1/2005 | Ishizuka et al. |
| 2006/0177587 | A1 | 8/2006 | Ishizuka et al. |

FOREIGN PATENT DOCUMENTS

| | | | |
|---|---|---|---|
| JP | 30-4393 | B1 | 6/1955 |
| JP | 2000-035279 | A1 | 2/2000 |
| JP | 2001-314799 | A1 | 11/2001 |
| JP | 2002-015711 | A1 | 1/2002 |
| JP | 2007-026698 | A | 2/2007 |
| JP | 3897456 | B2 | 3/2007 |
| WO | 2011/078309 | A1 | 6/2011 |

OTHER PUBLICATIONS

Extended European Search Report (Application No. 14756367.0) dated Dec. 8, 2016.
Chinese Office Action, Chinese Application No. 201480010619.9, dated Apr. 25, 2016 (7 pages).
English translation of an International Preliminary Report on Patentability (Application No. PCT/JP2014/054467) dated Sep. 11, 2015.

* cited by examiner

DRYING APPARATUS

BACKGROUND OF THE INVENTION

1. Field of the Invention

The present invention relates to a drying apparatus that dries an object to be dried containing a solvent.

2. Description of the Related Art

Conventionally, a drying apparatus has been known, which includes a furnace body; a movable body configured to move in an interior space of the furnace body, with an object to be dried containing a solvent loaded thereon; an infrared heater disposed above the movable body in the interior space of the furnace body; and gas supply unit for supplying a gas having a regulated temperature and humidity to the interior space of the furnace body (see, e.g., Japanese Patent No. 3897456).

SUMMARY OF THE INVENTION

In the apparatus described in the foregoing document, the infrared heater mainly has the function of drying the object by applying infrared radiation thereto. The gas supplied to the interior space of the furnace body mainly has the function of making uniform, as much as possible, the temperature of, and the solvent concentration in, a gas containing the solvent evaporating from the object in a near-surface region of the object. The higher the gas temperature in the near-surface region of the object and the lower the solvent concentration, the faster the drying rate of the object. Therefore, when the gas temperature and the solvent concentration in the near-surface region of the object become uniform, local variation in the drying rate of the object becomes less likely to occur, and the occurrence of deformation of, and cracks in, the object after drying can be reduced.

In the apparatus described in the foregoing document, if the volume of space through which the gas passes in the interior space of the furnace body is large, it is difficult to regulate "the temperature of, and the solvent concentration in, the gas containing the solvent" in the near-surface region of the object. This often makes it difficult to reduce local variation in the drying rate of the object. Additionally, the amount of the gas that needs to be supplied increases. Therefore, the volume of space through which the gas passes is preferably set at a small value. For properly drying the object with infrared radiation, there is a proper value for the distance between the infrared heater and the object (hereinafter also referred to as "heater-object distance"). Therefore, it is preferable to set the heater-object distance at a proper value.

However, in the apparatus described in the foregoing document, the infrared heater is disposed in the space (i.e., the interior space of the furnace body) through which the gas passes and in which the movable body moving with the object loaded thereon is disposed. This makes it difficult to independently and individually regulate the volume of the space through which the gas passes and the heater-object distance. There has been a demand for a drying apparatus capable of independently and individually regulating the volume of the space through which the gas passes and the heater-object distance.

The present invention aims to provide a drying apparatus that dries an object to be dried containing a solvent, and is capable of independently and individually regulating the volume of the space through which the gas passes and the heater-object distance.

A drying apparatus according to the present invention includes a furnace body which is the same as that described above, a movable body which is the same as that described above, and an infrared heater which is the same as that described above.

The drying apparatus according to the present invention is characterized in that it includes "a division wall configured to divide the interior space of the furnace body into a first space including the movable body and a second space including the infrared heater, the division wall being partially or entirely made of a material that transmits infrared radiation", and that a first gas having a regulated temperature and humidity is supplied to the first space defined by the division wall and the supplied first gas is discharged from the first space. An inert gas, such as nitrogen or argon, is preferably used as the first gas.

Thus, a space through which the first gas passes and in which the movable body moves with the object loaded thereon (first space) and a space in which the infrared heater is disposed (second space) are different spaces separated by the division wall. This makes it easier to independently and individually regulate the volume of the first space through which the first gas passes and the heater-object distance. Also, since the volume of the first space can be reduced by providing the division wall, it is easier to regulate "the temperature of, and the solvent concentration in, the gas containing the solvent" in the near-surface region of the object.

Additionally, the division wall that separates the infrared heater and the object is partially or entirely made of a material that transmits infrared radiation. Therefore, infrared radiation emitted from the infrared heater can pass through the division wall and reach the object. In other words, the presence of the division wall does not interfere with the infrared heater's "function of drying the object" described above.

In the drying apparatus according to the present invention, a plurality of infrared heaters are preferably arranged along a direction of travel of the movable body at a plurality of points spaced from each other in the second space. A plurality of first portions of the division wall, the first portions being located at positions corresponding to the respective infrared heaters in the direction of travel of the movable body, are preferably made of a material that transmits infrared radiation, whereas a plurality of second portions of the division wall, the second portions being located at positions corresponding to respective spaces between adjacent ones of the infrared heaters in the direction of travel of the movable body, are preferably made of a material that does not transmit infrared radiation.

Thus, even when the infrared heaters are spaced apart along the direction of travel of the movable body, the intensity of infrared radiation applied to the object can be made substantially uniform in the direction of travel of the movable body (the details will be described later on). As a result, by powering up each of the infrared heaters, it is possible to increase the distance between adjacent infrared heaters and decrease the number of infrared heaters.

The drying apparatus according to the present invention preferably further includes transmittance regulating unit for varying an infrared transmittance of the first portions of the division wall in accordance with a position in a direction (hereinafter also referred to as "width direction") orthogonal to the direction of travel of the movable body.

In the near-surface region of the object, "the temperature of, and the solvent concentration in, the gas containing the solvent" inevitably have variation in the width direction.

Therefore, the "variation in gas temperature and solvent concentration in the width direction" may cause variation in the drying rate of the object in the width direction. At the same time, the greater the intensity of infrared radiation applied to the object, the faster the drying rate of the object.

With the configuration described above, it is possible to regulate the "distribution of the intensity of infrared radiation applied to the object in the width direction" to compensate for the "variation in the drying rate of the object in the width direction" caused by the "variation in gas temperature and solvent concentration in the width direction". Therefore, even when there is "variation in gas temperature and solvent concentration in the width direction", the drying rate of the object can be made uniform as much as possible in the width direction. As a result, the thickness of the object after drying can be made uniform as much as possible in the width direction.

The greater the thickness of the object, the more noticeably the differences in drying rate appear as variation in the thickness of the object, due to a larger amount of contraction of the object in the thickness direction. This means that the greater the thickness of the object, the greater the "effect of making the thickness uniform" achieved by the transmittance regulating unit.

DETAILED DESCRIPTION OF THE INVENTION (Configuration)

An embodiment of a drying apparatus according to the present invention will now be described with reference to FIGS. 1 to 4. In FIGS. 1 to 4, an up-down direction (z-axis direction) corresponds to a vertical direction, and a right-left direction (x-axis direction) corresponds to a horizontal direction.

Figure 1:
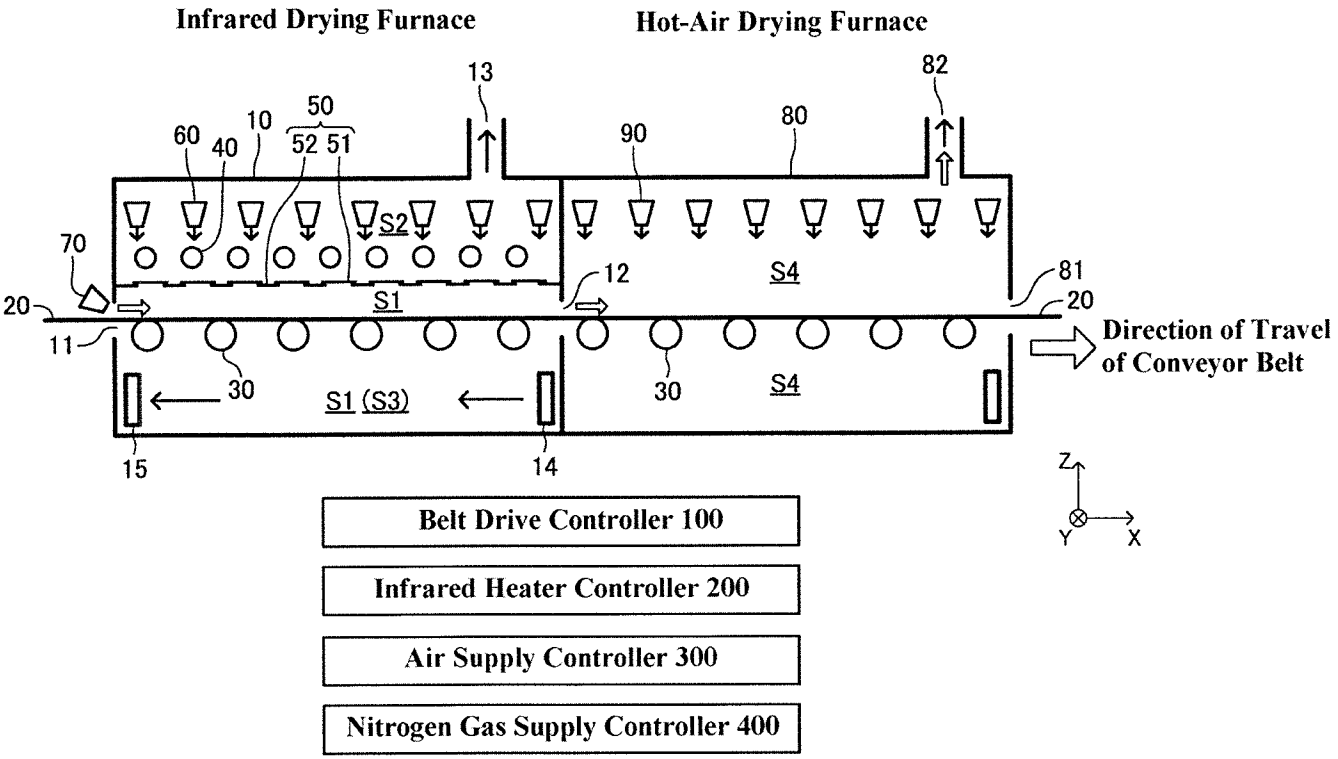
FIG. 1 is a schematic front cross-sectional view of an entire drying apparatus according to the present invention.

As illustrated in FIG. 1, the present embodiment is an apparatus that performs a drying process in which an object to be dried loaded on a conveyor belt 20 is dried to obtain a dry body. The conveyor belt 20 moves horizontally and parallel, from the left side to the right side of the drawing (i.e., in the positive direction of the x-axis). Hereinafter, the right-left direction in the drawing (i.e., the direction of travel of the conveyor belt 20, x-axis direction) will be referred to as "longitudinal direction", and the depth direction in the drawing (i.e., the direction orthogonal to the longitudinal direction, y-axis direction) will be referred to as "width direction".

The object to be dried (hereinafter referred to as "object") is typically a film-shaped compact of a "slurry containing ceramic powder or metal powder, a binder, and a solvent" extending in the longitudinal direction. The object is subjected to the drying process of the present embodiment, so that the solvent in the object is vaporized and removed to dry the object. Then, the dried object is fired (i.e., the binder is vaporized and removed) to form a final product (fired body).

The present embodiment includes an "infrared drying furnace" corresponding to the first half of the drying process, and a "hot-air drying furnace" corresponding to the second half of the drying process. First, the configuration of the infrared drying furnace will be described. Note that the drying process may be carried out by the "infrared drying furnace" alone.

The infrared drying furnace includes a furnace body 10. As illustrated in FIG. 1, the furnace body 10 has an entrance 11 and an exit 12 at both ends thereof in the longitudinal direction. The conveyor belt 20 horizontally extending in the longitudinal direction is configured to be horizontally movable from the entrance 11 toward the exit 12 in the interior space of the furnace body 10 while being guided by a plurality of guide rolls 30 arranged in the interior space of the furnace body 10. The speed of travel of the conveyor belt 20 is regulated by a belt drive controller 100 and a known belt drive mechanism (not shown).

Figure 2:
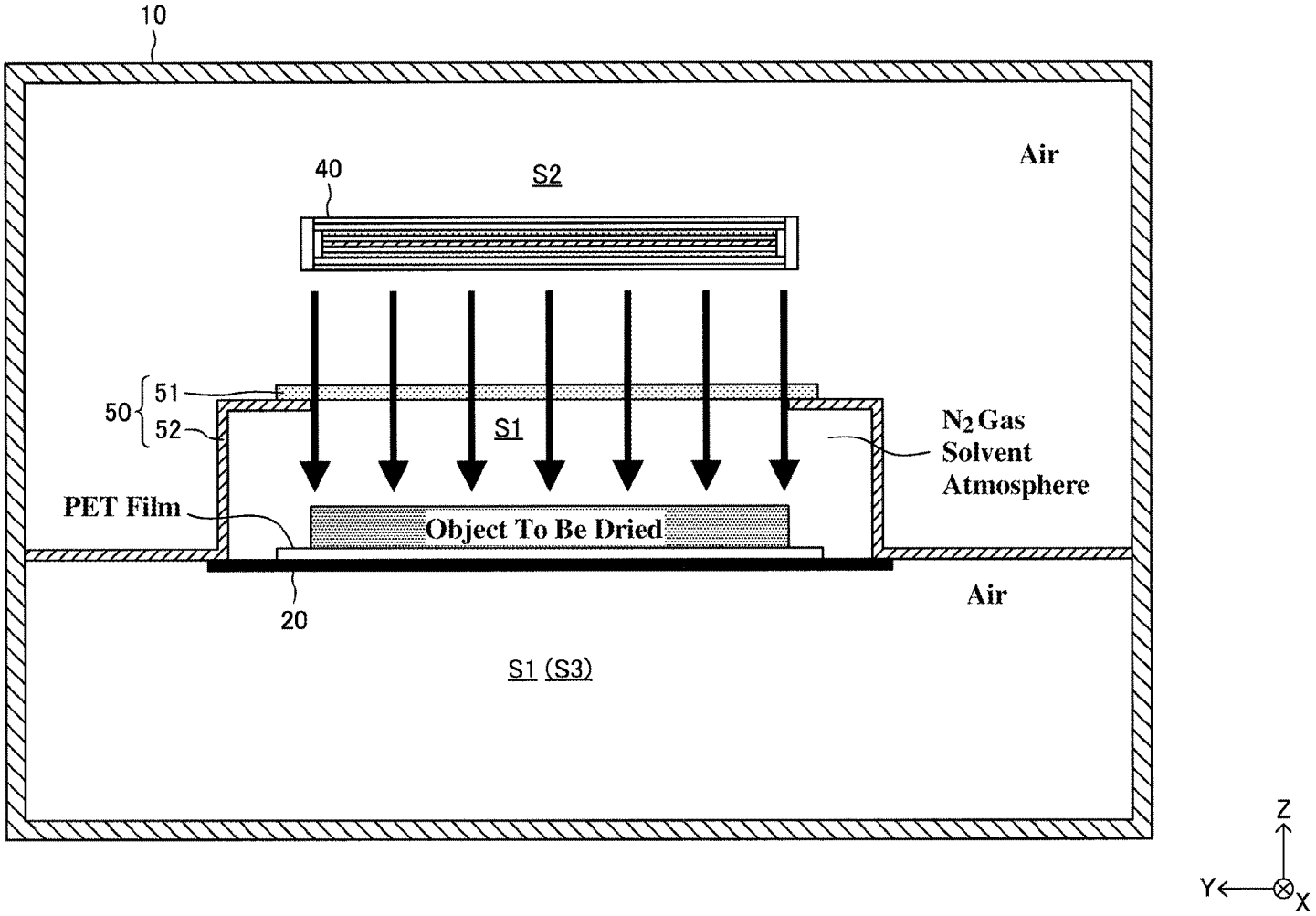
FIG. 2 is a schematic side cross-sectional view of the drying apparatus illustrated in FIG. 1.
Figure 3:
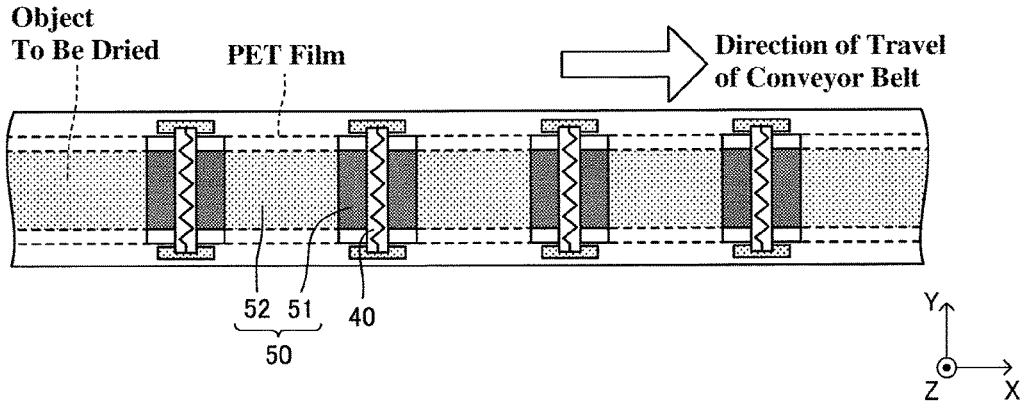
FIG. 3 is a schematic partial top cross-sectional view of the drying apparatus illustrated in FIG. 1.

As illustrated in FIG. 1, a plurality of infrared heaters 40 are arranged, above the conveyor belt 20 in the interior space of the furnace body 10, at predetermined intervals in the longitudinal direction. As illustrated in FIGS. 2 and 3, each of the infrared heaters 40 is rod-shaped. The infrared heaters 40 are arranged such that their axes are along the width direction. The intensity and the wavelength of infrared radiation emitted from the infrared heaters 40 are regulated by an infrared heater controller 200. Although the infrared heaters 40 are capable of emitting infrared radiation of various wavelengths, they are configured to typically emit infrared radiation (near-infrared radiation) with a dominant wavelength of about 6 μm or less.

As illustrated in FIGS. 1 and 2, the furnace body 10 includes a division wall 50 that horizontally extends in the longitudinal direction, and separates a space S1 including the conveyor belt 20 and a space S2 including the infrared heaters 40. As illustrated in FIGS. 1 to 3, the division wall 50 is formed by first portions 51 made of a material that transmits infrared radiation (in particular, near-infrared radiation), and second portions 52 made of a material that does not transmit infrared radiation (in particular, near-infrared radiation).

As illustrated in FIGS. 1 to 3, the second portions 52 horizontally extend in the longitudinal direction, and rectangularly protrude upward in the center in the width direction (y-axis direction). The top surface of the rectangular protrusion of each second portion 52 (i.e., horizontal flat surface extending in the longitudinal direction) has a window (rectangular opening) at a position corresponding to one infrared heater 40 in the longitudinal direction. The corresponding first portion 51 having a rectangular thin plate-like shape is disposed on the top surface of the second portion 52 to cover the window. Thus, as illustrated in FIG. 2, infrared radiation emitted from each infrared heater 40 passes through the corresponding first portion 51 to reach the object, which can be dried.

In the division wall 50, the first portions 51 are arranged at positions corresponding to the respective infrared heaters 40 in the longitudinal direction, whereas the second portions 52 are arranged at positions corresponding to respective spaces between adjacent infrared heaters 40 in the longitudinal direction.

Quartz glass is suitable as the material of the first portions 51. Quartz glass has the property of transmitting infrared radiation (near-infrared radiation) with a dominant wavelength of 3.5 μm or less at a high transmittance. Stainless steel is suitable as the material of the second portions 52. Stainless steel has the property of not transmitting infrared radiation (near-infrared radiation) with a dominant wavelength of about 6 μm or less. At the same time, stainless steel has the property of absorbing infrared radiation (near-infrared radiation) at a given rate, and thus has the effect of retaining heat in the division wall 50.

Aluminum alloy is also suitable as the material of the second portions 52. Aluminum alloy not only has the property of not transmitting infrared radiation (near-infrared radiation) with a dominant wavelength of about 6 μm or less, but also has a lower level of absorption of infrared radiation (near-infrared radiation) than stainless steel. This can reduce overheating of the division wall 50. Therefore, aluminum alloy is suitable for use in drying the object at relatively low temperatures.

In the present embodiment, as illustrated in FIG. 2, the lower surfaces of both ends of each second portion 52 in the width direction slightly overlap both ends of the upper surface of the conveyor belt 20 in the width direction. Thus, the space S1 is divided into a "space corresponding to the upper side of the conveyor belt 20" (i.e., the space defined by the rectangular protrusions in the center of the second portions 52 in the width direction, the first portions 51, and the conveyor belt 20), and a "space corresponding to the lower side of the conveyor belt 20". Hereinafter, the "space corresponding to the upper side of the conveyor belt 20" will be referred to as "space S1", and the "space corresponding to the lower side of the conveyor belt 20" will be particularly referred to as "space S3".

As illustrated in FIG. 1, a plurality of nozzles 60 for air are arranged, above the infrared heaters 40 in the space S2 of the furnace body 10, at predetermined intervals in the longitudinal direction. Temperature-regulated air is ejected downward from each of the nozzles 60 (see thin arrows). The division wall 50 is temperature-regulated by being exposed to the ejected air. The ejected air is discharged to the outside through an outlet 13 in the upper surface of the furnace body 10 (see a thin arrow).

Similarly, an inlet 14 and an outlet 15 for air are provided in the space S3 of the furnace body 10. From the inlet 14, temperature-regulated air is ejected in the negative direction of the x-axis (see a thin arrow). The conveyor belt 20 is temperature-regulated by being exposed to the ejected air. The ejected air is discharged to the outside through the outlet 15 (see a thin arrow). The temperature and the flow rate of air ejected from each nozzle 60 and the inlet 14 are regulated by an air supply controller 300.

As illustrated in FIG. 1, a nozzle 70 for nitrogen gas ($N_2$ gas) is disposed near the entrance 11 of the furnace body 10. From the nozzle 70, a nitrogen gas having a regulated temperature and humidity is ejected in the positive direction of the x-axis toward the interior of the space S1 (see an open arrow). Thus, by the flow of nitrogen gas in the positive direction of the x-axis in the space S1, the temperature of, and the solvent concentration in, the "gas containing the solvent evaporating from the object" are made uniform as much as possible in a near-surface region of the object. The nitrogen gas passing through the space S1 is discharged through the exit 12 into an interior space S4 of a furnace body 80 described below (see an open arrow). The temperature, humidity, flow rate, and the like of the nitrogen gas ejected from the nozzle 70 are regulated by a nitrogen gas supply controller 400.

The configuration of the "infrared drying furnace" has been described. Next, the configuration of the "hot-air drying furnace" will be described.

As illustrated in FIG. 1, the hot-air drying furnace includes the furnace body 80 connected to a side of the furnace body 10 on the positive side of the x-axis. The interior of the furnace body 80 is formed by the single space S4. The furnace body 80 has the "exit 12 of the furnace body 10" serving as an entrance and an exit 81 at both ends thereof in the longitudinal direction. The conveyor belt 20 moving from the exit 12 of the furnace body 10 is configured to horizontally move in the space S4 of the furnace body 80 from the entrance (i.e., the exit 12 of the furnace body 10) toward the exit 81 while being guided by a plurality of guide rolls 30 arranged in the space S4 of the furnace body 80.

As illustrated in FIG. 1, a plurality of nozzles 90 for air are arranged, in the upper part of the space S4 of the furnace body 80, at predetermined intervals in the longitudinal direction. Air heated to a high temperature (hot air) is ejected downward from each of the nozzles 90 (see thin arrows). The object is further dried by being exposed to the ejected air (hot air). The ejected air (hot air) is discharged to the outside through an outlet 82 in the upper surface of the furnace body 80 (see a thin arrow). A nitrogen gas flowing from the exit 81 into the space S4 is also discharged through the outlet 82 to the outside (see an open arrow). The configuration of the "hot-air drying furnace" has thus been described.

The operation of the embodiment configured as described above will now be briefly described. In the present embodiment, as illustrated in FIG. 2, the object (typically, a thin film-shaped compact of slurry) extending in the longitudinal direction is loaded on the upper surface of the conveyor belt 20, with a PET film therebetween. The PET film is used to simplify the handling of the object. After completion of drying the object, the PET film is removed from the object. The PET film has the property of transmitting near-infrared radiation and absorbing far-infrared radiation. From this point of view, it is preferable that infrared radiation emitted from the infrared heaters 40 be near-infrared radiation.

The conveyor belt 20 carrying the object moves horizontally and parallel in the positive direction of the x-axis at a predetermined speed. Infrared radiation (near-infrared radiation) is emitted from each of the infrared heaters 40 at a predetermined intensity. The emitted infrared radiation (near-infrared radiation) passes through the corresponding first portion 51 of the division wall 50 to reach the object, which is thus dried.

From the nozzle 70, a nitrogen gas having a regulated temperature and humidity is ejected in the positive direction of the x-axis toward the interior of the space S1. Thus, the nitrogen gas flows in the space S1 in the positive direction of the x-axis. By the flow of nitrogen gas in the space S1, the temperature of, and the solvent concentration in, the "gas containing the solvent evaporating from the object" are made uniform as much as possible in the near-surface region of the object. As a result, local variation in the drying rate of the object becomes less likely to occur, and the occurrence of deformation of, and cracks in, the object after drying can be reduced. As described above, the greater the thickness of the object, the greater the action and effect described above.

From each of the nozzles 60, temperature-regulated air (e.g., air at room temperature) is ejected toward the inside of the space S2. At the same time, from the inlet 14, temperature-regulated air (e.g., air at a temperature slightly higher than room temperature) is ejected toward the inside of the space S3. As a result, the temperature of the division wall 50 and the temperature of the conveyor belt 20 (i.e., the temperature of the object) are set and maintained at proper temperatures. As described above, the temperature of air ejected from the nozzles 60 is set to be lower than that of air ejected from the inlet 14. This is because the air ejected from the nozzles 60 is slightly warmed in the space S2 by infrared radiation emitted from the infrared heaters 40. Thus, the temperature of the air that reaches the division wall 50 after being ejected from the nozzles 60 can be substantially the same as the temperature of the air that reaches the conveyor belt 20 after being ejected from the inlet 14.

Thus, the object that moves with the conveyor belt 20 in the "infrared drying furnace" is dried by the action of infrared radiation while being kept at a temperature slightly higher than room temperature, with little local variation in drying rate because of the action of flow of nitrogen gas in the space S1. As a result, the object can be obtained, which is dried to some extent without cracks and significant variation in thickness.

The object is then moved from the "infrared drying furnace" to the "hot-air drying furnace". In the furnace body 80 of the hot-air drying furnace, air heated to a high temperature (hot air) is ejected from each of the nozzles 90 toward the inside of the space S4. As a result, the object that moves with the conveyor belt 20 in the "hot-air drying furnace" is further dried under high temperature by the action of the ejected air (hot air). Thus, at the stage when the object is discharged from the exit 81 of the furnace body 80, the drying of the object is completed, that is, a dry body is obtained. The object is sufficiently dried at the stage of being discharged from the "infrared drying furnace". Therefore, even when the object is further subjected to a high temperature after this stage, the occurrence of cracks and significant variation in thickness can be avoided.

(Action and Effect)

The action and effect of the present embodiment will now be described. In the present embodiment, the "space through which nitrogen gas passes and in which the conveyor belt 20 moving with the object loaded thereon is disposed" (space S1) and the space in which the infrared heaters 40 are arranged (space S2) are different spaces separated by the division wall 50. This makes it easier to independently and individually regulate the "volume of the space S1 through which nitrogen gas passes" and the "heater-object distance". Also, since the volume of the space S1 can be reduced by providing the division wall 50, it becomes easier to regulate "the temperature of, and the solvent concentration in, the gas containing the solvent" in the near-surface region of the object.

Figure 4:
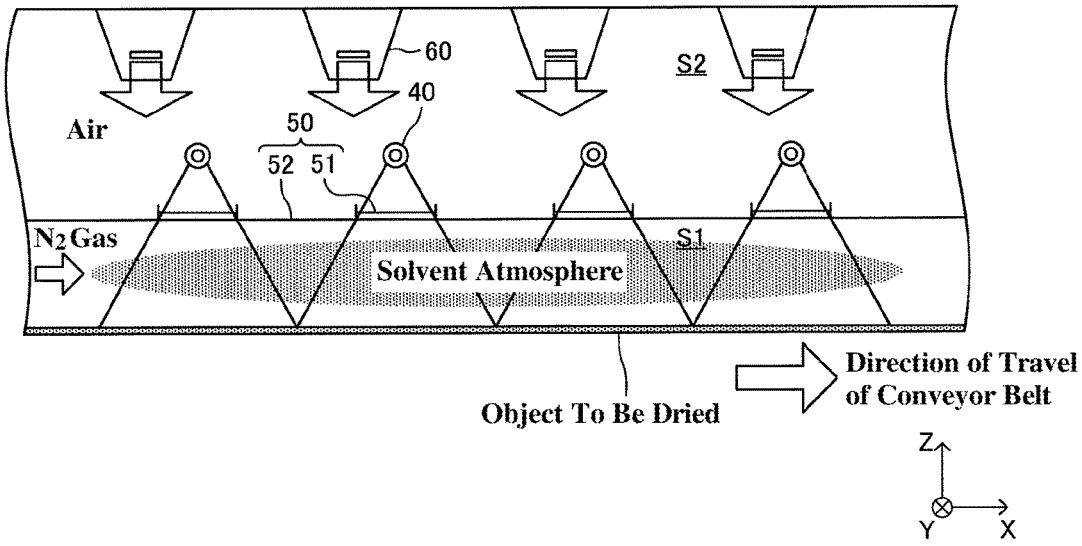
FIG. 4 is a schematic partial front cross-sectional view of the drying apparatus illustrated in FIG. 1.

Additionally, in the division wall 50, as illustrated in FIGS. 3 and 4, the first portions 51 (portions transmitting infrared radiation) are arranged at positions corresponding to the respective infrared heaters 40 in the longitudinal direction, whereas the second portions 52 (portions not transmitting infrared radiation) are arranged at positions corresponding to respective spaces between adjacent infrared heaters 40 in the longitudinal direction.

Thus, by regulating the distance between adjacent infrared heaters 40 and the length of the first portions 51 of the division wall 50 in the longitudinal direction as illustrated in FIG. 4, infrared radiation can be applied to the entire surface of the object without overlapping of beams of infrared radiation emitted from adjacent infrared heaters 40 in the longitudinal direction (or with partial overlapping of beams of infrared radiation in the longitudinal direction). In other words, even when the infrared heaters 40 are spaced apart in the longitudinal direction, the intensity of infrared radiation applied to the object can be made substantially uniform in the longitudinal direction. As a result, by powering up each of the infrared heaters 40, it is possible to increase the distance between adjacent infrared heaters 40 and decrease the number of infrared heaters 40.

The present invention is not limited to the embodiments described above, and can adopt various modifications within the scope thereof. For example, although a nitrogen gas is used as a gas that flows in the space S1 in the embodiments described above, any inert gas, such as argon, may be used.

Although the division wall 50 is formed by the first portions 51 (portions transmitting infrared radiation) and the second portions 52 (portions not transmitting infrared radiation) in the embodiments described above, the division wall 50 may be formed entirely by the first portions 51 (portions transmitting infrared radiation).

In the embodiments described above, the lower surfaces of both ends of each second portion 52 of the division wall 50 in the width direction slightly overlap both ends of the upper surface of the conveyor belt 20 in the width direction. Thus, the space S1 is divided into the "space S1 corresponding to the upper side of the conveyor belt 20" and the "space S3 corresponding to the lower side of the conveyor belt 20". Alternatively, the space S1 may be a single space in which the "space on the upper side of the conveyor belt 20" is continuous with the "space on the lower side of the conveyor belt 20".

In the embodiments described above, "the temperature of, and the solvent concentration in, the gas containing the solvent" in the near-surface region of the object inevitably have variation in the width direction in the space S1. Therefore, the "variation in gas temperature and solvent concentration in the width direction" may cause variation in the drying rate of the object in the width direction. At the same time, the greater (smaller) the intensity of infrared radiation applied to the object, the faster (slower) the drying rate of the object.

By regulating the "distribution of the intensity of infrared radiation applied to the object in the width direction" on the basis of the findings described above, it is possible to compensate for "variation in the drying rate of the object in the width direction" caused by "variation in gas temperature and solvent concentration in the width direction". For example, if the solvent concentration in the "gas containing the solvent" is higher in the center of the space S1 in the width direction than at both ends of the space S1 in the width direction, the drying rate of the object is greater at both ends than in the center in the width direction. In this case, the thickness of the object tends to be greater at both ends than in the center in the width direction.

Figure 5:
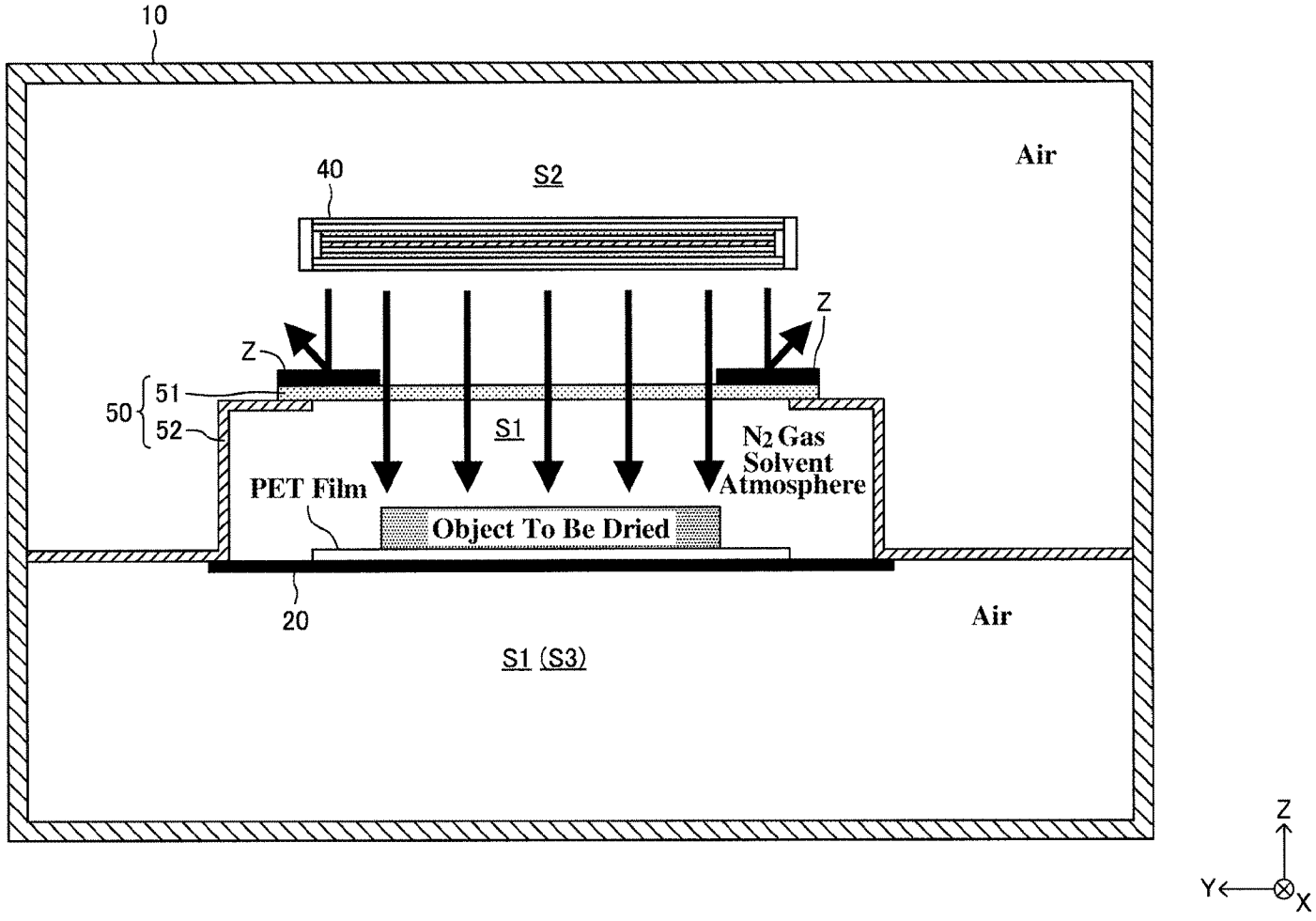
FIG. 5 corresponds to FIG. 2 and illustrates a modified drying apparatus according to the present invention.

In such a case, for example, as illustrated in FIG. 5, by providing shielding members Z not transmitting infrared radiation (near-infrared radiation) on the upper surfaces of both ends of each first portion 51 of the division wall 50 in the width direction, the intensity of infrared radiation applied to the object can be made lower at both ends than in the center in the width direction. Thus, the drying rate of the object can be made uniform as much as possible in the width direction. As a result, the thickness of the object after drying can be made uniform as much as possible in the width direction.

In the example illustrated in FIG. 5, the shielding members Z not transmitting infrared radiation (near-infrared radiation) are disposed on the upper surfaces of both ends of the first portion 51 of the division wall 50 in the width direction. If, for example, the solvent concentration in the "gas containing the solvent" is lower in the center of the space S1 in the width direction than at both ends of the space S1 in the width direction, it is preferable that the shielding member Z not transmitting infrared radiation (near-infrared radiation) be disposed on the upper surface of the center of each first portion 51 of the division wall 50 in the width direction.

In the example illustrated in FIG. 5, components that completely block infrared radiation are used as the shielding members Z. Alternatively, components that transmit infrared radiation (near-infrared radiation) to some degree (i.e., components having an infrared (near-infrared) transmittance lower than the first portions 51) may be used as the shielding members Z.

Also, in the example illustrated in FIG. 5, the shielding members Z are provided on the upper surface of each first portion 51 of the division wall 50 so as to regulate the "distribution of the intensity of infrared radiation applied to the object in the width direction". Alternatively, the infrared (near-infrared) transmittance of the first portions 51 may be varied in the width direction to regulate the "distribution of the intensity of infrared radiation applied to the object in the width direction".

The present application claims priorities from Japanese patent application No. 2013-035924 filed on Feb. 26, 2013, and Japanese patent application No. 2013-218253 filed on Oct. 21, 2013, the entire contents of both of which are incorporated herein by reference.

What is claimed is:

1. A drying apparatus that dries an object to be dried containing a solvent, the drying apparatus comprising:

a furnace body;

a movable body configured to move in an interior space of the furnace body, with the object loaded thereon;

an infrared heater disposed above the movable body in the interior space of the furnace body;

a division wall configured to divide the interior space of the furnace body into a first space including the movable body and a second space including the infrared heater, the division wall being partially or entirely made of a material that transmits infrared radiation, wherein the infrared heater comprises a plurality of infrared heaters arranged along a direction of travel of the movable body at a plurality of points spaced from each other in the second space, and the division wall comprises a plurality of first portions located at positions corresponding to the respective infrared heaters in the direction of travel of the movable body, the first portions are made of a material that transmits infrared radiation, whereas a plurality of second portions of the division wall are located at positions corresponding to respective spaces between adjacent ones of the infrared heaters in the direction of travel of the movable body, the second portions are made of a material that does not transmit infrared radiation;

a transmittance regulating unit for varying an infrared transmittance of the first portions of the division wall in accordance with a position in a direction orthogonal to the direction of travel of the movable body; and first gas supply/discharge unit for supplying a first gas having a regulated temperature and humidity to the first space, and discharging the first gas supplied to the first space from the first space.

2. The drying apparatus according to claim 1, further comprising second gas supply/discharge unit for supplying a second gas different from the first gas to the interior space of the furnace body, and discharging the second gas supplied to the interior space from the interior space.

3. A method for manufacturing a dry body using the drying apparatus according to claim 1, the method comprising, while the first gas supply/discharge unit is supplying the first gas to the first space and discharging the supplied first gas from the first space and the infrared heater is emitting infrared radiation toward the division wall, moving the movable body carrying the object in the first space to dry the object to manufacture the dry body.

4. A method for manufacturing a dry body using the drying apparatus according to claim 2, the method comprising, while the first gas supply/discharge unit is supplying the first gas to the first space and discharging the supplied first gas from the first space and the infrared heater is emitting infrared radiation toward the division wall, moving the movable body carrying the object in the first space to dry the object to manufacture the dry body.

* * * * *